US006401767B1

(12) United States Patent
Cohen et al.

(10) Patent No.: US 6,401,767 B1
(45) Date of Patent: Jun. 11, 2002

(54) APPARATUS AND METHOD FOR GROUNDING COMPRESSED FUEL FUELING OPERATOR

(75) Inventors: Joseph Perry Cohen, Bethlehem; David John Farese, Riegelsville; Jianguo Xu, Wrightstown, all of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/862,259

(22) Filed: May 22, 2001

(51) Int. Cl.[7] ..... B65B 1/04; B65B 3/04

(52) U.S. Cl. ..... 141/1; 141/94; 141/98; 141/192; 141/197; 362/215; 362/216; 307/326

(58) Field of Search ..... 141/1, 18, 83, 141/94, 98, 192, 197, 311 R; 361/212, 215, 216; 137/456; 340/649; 307/326

(56) References Cited

U.S. PATENT DOCUMENTS

| | | | | |
|---|---|---|---|---|
| 4,319,303 A | * | 3/1982 | Thorn | 361/215 |
| 5,029,622 A | | 7/1991 | Mutter | 141/4 |
| 5,159,523 A | * | 10/1992 | Claassen et al. | 340/649 |
| 5,329,164 A | * | 7/1994 | Saito | 123/198 DC |
| 5,927,316 A | * | 7/1999 | Merrill | 137/456 |

OTHER PUBLICATIONS

National Fire Protection Association Code NFPA 77 "Recommended Practice on Static Electricity", Section 4–5.3.6.

Von Pidoll et al., "Avoidance of Electrostatic Hazards During Refueling of Motorcars," *Journal of Electrostatics*, 40 & 41, 1997, pp. 523–528.

Kassebaum & Kocken, "Controlling Static Electricity in Hazardous (Classified) Locations," *IEEE Trans. On Indus. Applics.*, vol. 33, No. 1, Jan./Feb. 1997.

* cited by examiner

*Primary Examiner*—Timothy L. Maust
(74) *Attorney, Agent, or Firm*—Keith D. Gourley

(57) ABSTRACT

A safety system for grounding an operator at a fueling station prior to removing a fuel fill nozzle from a fuel tank upon completion of a fuel filling operation is provided which includes a fuel tank port in communication with the fuel tank for receiving and retaining the nozzle during the fuel filling operation and a grounding device adjacent to the fuel tank port which includes a grounding switch having a contact member that receives physical contact by the operator and where physical contact of the contact member activates the grounding switch. A releasable interlock is included that provides a lock position wherein the nozzle is locked into the port upon insertion of the nozzle into the port and a release position wherein the nozzle is releasable from the port upon completion of the fuel filling operation and after physical contact of the contact member is accomplished.

22 Claims, 6 Drawing Sheets

APPARATUS AND METHOD FOR GROUNDING COMPRESSED FUEL FUELING OPERATOR

STATEMENT REGARDING FEDERALLY SPONSORED RESEARCH OR DEVELOPMENT

This invention was made with Government Support under Contract No. DE-FC08-99NV13578 between Air Products and Chemicals, Inc., and the United States Department of Energy. The Government has certain rights to this invention.

CROSS-REFERENCE TO RELATED APPLICATIONS

Not applicable.

BACKGROUND OF THE INVENTION

The present invention is directed to apparatus and methods for fueling fuel tanks with compressed fuel. In particular, the present invention is directed to the grounding of an operator during the compressed fuel fueling process.

Fueling the fuel tanks of vehicles and other mobile apparatus with gaseous fuels such as hydrogen or compressed natural gas can be accomplished rapidly by discharging the fuel from high pressure storage vessels into, for example, the fuel tank or storage vessel in the vehicle or other mobile apparatus requiring fuel. It is imperative that the fuel be delivered safely to the vehicle. The point of the fueling process that may pose a potential hazard occurs when the operator disconnects the fuel fill nozzle from the vehicle. The operator may have built up static charge upon his or her person. If there is a leak of fuel from the station or vehicle, then, as the operator tries to remove the nozzle, a spark from a static discharge may ignite the gaseous fuel.

This may also be a hazard with liquid fuels. However, to date, the industry has not adequately addressed the problem. This may change since there were more than forty reports of gasoline fires due to operator static in the combined years of 1999 and 2000.

In the past, there have been a limited number of known attempts to directly address fueling of vehicles with compressed gas and the problem of potential fires due to static discharge. For example, in U.S. Pat. No. 5,029,622 (Mutter), an automated process for filling a vehicle with a compressed gas is described. However, there is no disclosure related to reducing or eliminating the problem of static discharge from the operator during the fuel filling operation.

It is known that vehicle static discharge may be avoided by use of a conductive fuel hose. This may be done for both gasoline as well as natural gas vehicles pursuant to National Fire Protection Association Code NFPA 77 "Recommended Practice on Static Electricity." Section 4-5.3.6. of NFPA 77 states "all metallic parts of the fill pipe assembly should form a continuous electrically conductive path downstream from the point of bonding. For example, insertion of a nonconductive hose equipped with a metal coupling on the outlet must be avoided unless the coupling is bonded to the fill pipe."

In Von Pidoll et. al. "Avoidance of Electrostatic Hazards During Refueling of Motorcars," *Journal of Electrostatics*, 40 &41, 1997, pages 523–528, the authors note that there were more than 30 ignitions of gasoline/air mixtures at public filling stations in Germany in a particular time period. One of their recommendations is the use of antistatic seats in all cars. This suggestion has not been accepted for gasoline cars to date, and it does not seem that this recommendation will be accepted for alternative fuels in the near future. This suggestion also does not protect the operator from other sources of static buildup such as their clothes.

In Kassebaum & Kocken, "Controlling Static Electricity in Hazardous (Classified) Locations," *IEEE Trans. On Indus. Applics.*, Vol. 33, No. 1, January/February 1997, the authors recommend the use of conductive soled shoes for certain areas where there is potential for fire due to presence of flammable liquids, gases and dusts. A fueling station for the fueling of, for example, hydrogen gas, as used in the present invention, can be considered such an area where conductive soled shoes might be recommended. However, it cannot be expected that customers of fueling stations for hydrogen fuel for, for example, a fuel cell powered vehicle, have the correct footwear if such hydrogen fuel stations are going to be widely commercialized.

It is principally desired to provide a safety system and method for grounding an operator at a fueling station prior to removing a fuel fill nozzle from a fuel tank upon completion of a fuel filling operation.

It is further desired to provide a safety system and method for grounding an operator at a fueling station prior to removing a fuel fill nozzle from a fuel tank upon completion of a fuel filling operation that is simple and relatively inexpensive.

It is still further desired to provide a safety system and method for grounding an operator at a fueling station prior to removing a fuel fill nozzle from a fuel tank upon completion of a fuel filling operation that is not prone to operator error.

Finally, it is desired to provide a safety system and method for grounding an operator at a fueling station prior to removing a fuel fill nozzle from a fuel tank upon completion of a fuel filling operation that is specifically for use for hydrogen in fuel cell tanks, but may also be used with respect to filling other fuel tanks with flammable fuels.

BRIEF SUMMARY OF THE INVENTION

The present invention is directed to the grounding of such an operator subsequent to the filling operation and prior to removal of the fuel fill nozzle. In the present invention, the operator is either notified that he must ground himself prior to removal of the nozzle, or the nozzle itself is locked into the vehicle port. Automatic nozzles that lock and unlock to a vehicle port have been built for natural gas vehicle (NGV) service, for example, the WEH GmbH of Germany, nozzle type WEH TK 18, but none is locked or unlocked by action of grounding.

While the present invention addresses grounding of an operator while filling a fuel cell tank with hydrogen, all embodiments of the present invention apply equally well to filling a fuel tank with a flammable gas or flammable liquid that emits flammable vapors, such as gasoline. It is believed that the present invention is the first attempt to solve the problem of potential static discharge at the end of a vehicle fill process by the grounding of the fuel fill operator.

The first embodiment of the present invention is directed to a safety system for grounding an operator at a fueling station prior to removing a fuel fill nozzle from a fuel tank upon completion of a fuel filling operation. The safety system includes a fuel tank port in communication with the fuel tank for receiving and retaining the fuel fill nozzle during the fuel filling operation. The safety system further includes a grounding device adjacent to the fuel tank port which includes a grounding switch having a contact member that receives physical contact by the operator. Physical contact of the contact member by the operator activates the grounding switch. A releasable interlock is also included that provides a lock position wherein the nozzle is locked into the port upon insertion of the nozzle into the port and a release position wherein the nozzle is releasable from the port upon completion of the fuel filling operation and after physical contact of the contact member is accomplished. Accidental ignition of fuel due to static discharge is thereby prevented.

Preferably, the grounding device is located at least two centimeters from the nozzle. Additionally, it is preferable that the fuel source contain a compressed fuel and the fuel is hydrogen.

The releasable interlock may be a manually activated nozzle lever, wherein movement of the nozzle lever in a first direction locks the nozzle to the fuel tank port and wherein movement of the nozzle lever in a second direction unlocks the nozzle from the fuel tank port only upon activation of the grounding switch. Preferably, the first direction and the second direction are opposed, i.e., are directed 180 degrees from one another. For example, the first direction may be toward the left and the second direction may be toward the right, although such feature is not essential or required. Many combinations of first and second directions can be engineered without undue experimentation.

A timer may be included that is connected to the releasable interlock where the timer provides for the releasable interlock to remain in the release position for a limited time period subsequent to activation of the grounding switch. The timer provides for the releasable interlock to remain in the locked position at all other times when the nozzle is received in the port. The limited time period may be about one to three hundred seconds and preferably about five seconds.

An indicator to provide indication that the nozzle may safely be removed from the receptacle may be provided where the indicator provides indication during the limited time period.

The grounding switch may be integral to the releasable interlock. The releasable interlock may be a lever that moves from the lock position to the release position, whereby the lever blocks the nozzle from removal from the fuel tank port until moved from the lock position to the release position. A grounding verification switch adjacent to the nozzle and a timer connected to the releasable interlock may also be provided. The grounding verification switch is connected to a fuel controller where the fuel controller enables flow of the fuel from the nozzle only during activation of the grounding verification switch and the timer provides for the releasable interlock to remain in the release position for a limited time period subsequent to release of the grounding verification switch. The grounding verification switch may include an activation handle on the nozzle that controls flow of fuel.

A grounding verification switch may be included along with a timer. The grounding verification switch connects to the fuel controller, the fuel controller enabling flow of the fuel from the nozzle only during activation of the grounding verification switch. The timer is connected to the fuel controller and provides for flow of fuel to resume once halted by release of the grounding verification switch for a limited time period subsequent to release of the grounding verification switch. The fuel controller provides for no fuel to flow after the limited time period has been reached until the grounding switch is re-activated.

Another embodiment of a safety system for grounding an operator at a fueling station during a fuel filling operation is also provided which includes a fuel tank port in communication with a fuel tank for receiving a fuel fill nozzle, a grounding device adjacent to the fuel tank port, the grounding device including a grounding switch having a contact member to receive physical contact by the operator. Physical contact of the contact member activates the grounding switch. A fuel controller is provided for providing fuel flow through the nozzle only when the grounding switch is continuously activated.

Another embodiment of a safety system for grounding an operator at a fueling station during a fuel filling operation is also provided which includes a fuel tank port in communication with a fuel tank for receiving a fuel fill nozzle, a grounding device adjacent to the fuel tank port, the grounding device including a contact member connected to ground which is adapted to receive physical contact by the operator, and a fuel controller for controlling fuel flow through the nozzle. The fuel controller provides for a flow of fuel, and provides a signal when the controller provides for fuel to stop flowing. An indicator is also provided that indicates to the operator, immediately upon receiving the signal, that grounding must take place prior to removal of the nozzle.

A method for grounding an operator at a fueling station is also provided which includes the steps of providing the apparatus of the first embodiment, withdrawing the fuel fill nozzle from a fuel source boot, inserting the fuel fill nozzle into the fuel tank port whereby the nozzle is locked into the fuel tank port, filling the fuel tank with fuel from a fuel source, contacting the contact member to activate the grounding switch of the grounding member to release the releasable interlock, and withdrawing the nozzle from the port. The operator may also have to contact a grounding verification switch that is connected to ground during the activation process. The operator may have a limited time period in which he or she must remove the nozzle from the port after the fueling and grounding process is complete.

Another method for grounding an operator at a fueling station during a fuel filling operation is also provided which includes providing a fuel tank port in communication with a fuel tank for receiving a fuel fill nozzle during the fuel filling operation. A grounding device adjacent to the fuel tank port is provided wherein the grounding device includes a grounding switch having a contact member to receive physical contact by the operator, wherein physical contact of the contact member activates the grounding switch. A fuel controller is provided that is activatable by the grounding switch to provide fuel flow through the nozzle only when the grounding switch is continuously activated. The contact member is physically contacted to activate the grounding switch which activates the fuel controller to provide fuel flow.

Finally, in another embodiment of the present invention, a method for grounding an operator at a fueling station during a fuel filling operation is provided which includes providing a fuel fill nozzle connected to a fuel source, providing a fuel tank port in communication with a fuel tank for receiving the fuel fill nozzle, and providing a grounding device adjacent to the fuel tank port, the grounding device including a contact member connected to ground which is adapted to receive physical contact by the operator. A fuel controller for controlling fuel flow through the nozzle is also provided where the fuel controller provides a signal when the controller provides fuel to stop flowing. An indicator is provided that indicates to the operator, immediately upon receiving the signal, that grounding must take place prior to removal of the nozzle. The nozzle is inserted into the fuel tank port, a desired quantity of fuel is input into the fuel tank via the fuel controller until the desired quantity of fuel has been transferred or the fuel tank has reached capacity. The signal from the controller to the indicator is provided to indicate to the operator that the operator must contact the contact member. The operator contacts the contact member and the nozzle is removed from the fuel tank port.

DETAILED DESCRIPTION OF THE INVENTION

The present invention is directed to apparatus and methods for grounding an operator during a fuel filling operation immediately before removing the fuel fill nozzle from the vehicle by the operator. By using the present invention, static discharge from the operator during the nozzle disconnection process will not likely cause ignition of fuel or vapor that has leaked from the fuel nozzle/vehicle fuel port area during the normal fueling process.

While this invention is primarily directed to a fuel filling process for filling hydrogen gas in a fuel cell fuel tank, the present invention would apply equally well to filling a fuel tank with any flammable gas or flammable liquid that emits flammable vapors, such as gasoline.

It is preferred that grounding of the operator occur at a grounding point adjacent to the fuel tank port of the vehicle. For purposes of the present invention, "adjacent" means a distance that is any suitable distance between the fuel tank port and the grounding point. For example, the distance between the dispenser and the fuel tank port, or, for example, two to ten feet or even more may typically be appropriate. Any distance of at least two centimeters will likely allow for proper grounding in accordance with this invention.

Figure 1:
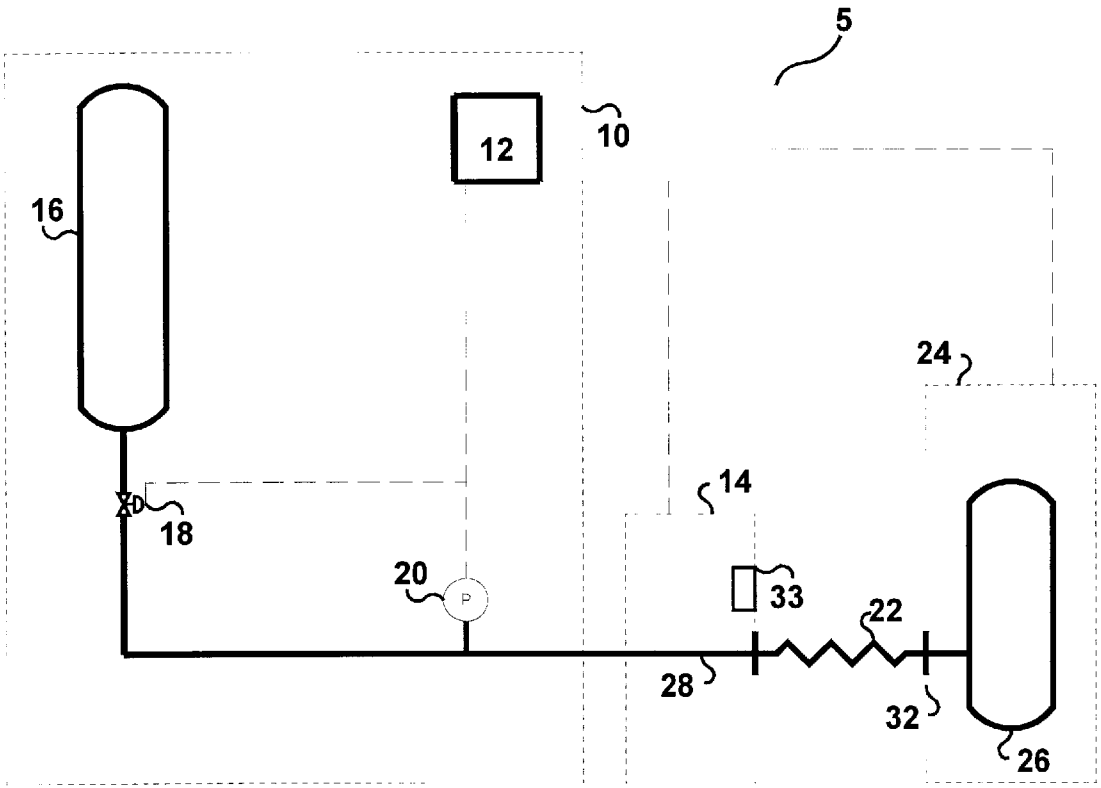
FIG. 1 is a simplified schematic diagram of a fueling station in combination with a fuel dispenser and fuel storage vessel in accordance with one preferred embodiment of the present invention.

Referring now to the drawings, wherein like reference numbers refer to like elements throughout the several views, there is shown in FIG. 1 a safety system 5 for rounding an operator at a fueling station 10 prior to removing the fuel fill nozzle 22 from he fuel tank port 32 of the vehicle 24.

For purposes of the present invention, vehicle 24 means a vehicle such as an automobile or other mobile or portable apparatus that has a fuel tank 26 that is to be filled with a flammable gas or liquid fuel.

The fueling station 10 consists of a station controller 12 which may be located in a fuel dispenser 14 or elsewhere in the station 10. The station 10 will also include a source of compressed fuel such as a fuel storage vessel 16, fuel flow controller 18 for controlling flow of fuel, and a monitor 20 for the monitoring flow of fuel. Again, the fuel flow controller 18 and monitor 20 may be located in the dispenser 14, or elsewhere in the station 10. The fuel flows from the fuel storage vessel 16 through a fuel conduit 28 to a fuel flow nozzle 22. The fuel flow nozzle 22 mates with the fuel tank port 32 in the vehicle 24. The dispenser will also have a resting place, or boot, 33, for supporting the nozzle when not filling the vehicle.

Figure 2:
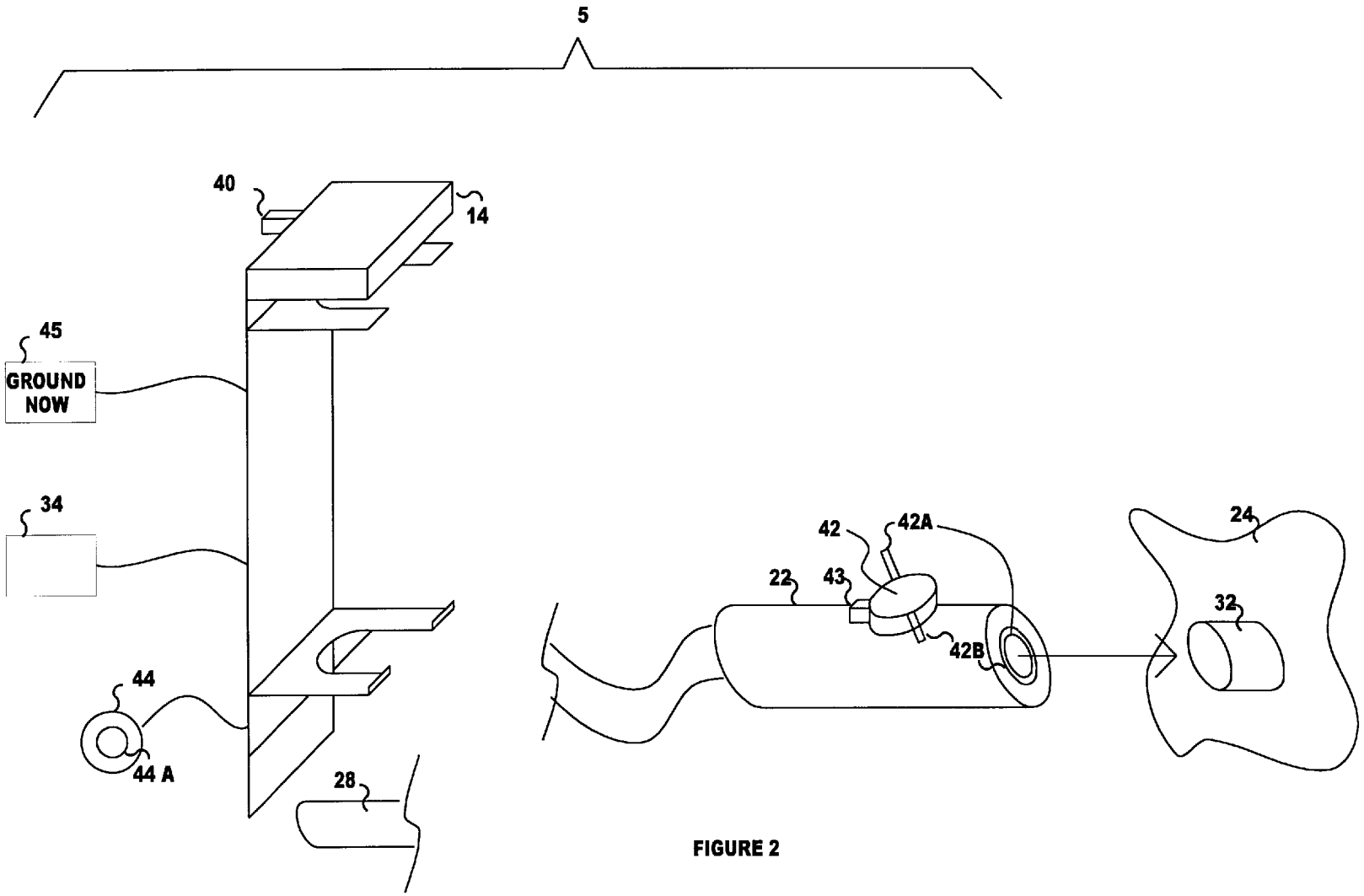
FIG. 2 is a simplified view of a nozzle and port in accordance with one preferred embodiment of the present invention, for use in the fuel filling station of FIG. 1.

As can be seen most clearly in FIG. 2, a primary inventive aspect of one preferred embodiment of the safety system 5 of the present invention is the use of a releasable interlock 42 for the nozzle 22 with respect to the port 32. The releasable interlock 42 functions to lock the fuel fill nozzle 22, using manual, pneumatic or other form of automatic function, as generally known, that causes the fuel fill nozzle 22 to securely lock to the vehicle fuel tank nozzle port 32 unless and until the operator has grounded him or herself to the station by a grounding device 44. The grounding device 44 includes a contact member 44A and a grounding switch 40 wherein physical contact of the contact member 44A, preferably contact by skin, activates the grounding switch 40 to cause (for an automatic version; see below) or allow (for a manual version; see below) the releasable interlock 42 to move from a lock position 42A to a release position 42B to provide that the fuel fill nozzle 22 be releasable such that it can be removed from the fuel tank nozzle port 32 by the operator.

It is recognized that it is preferable that the contact member 44A of the grounding device 44 sense actual physical skin-to-contact member contact such that electrical contact from the operator to ground is made. However, since it may be desirable to construct a safety system that is as simple and inexpensive as possible, the present invention also anticipates the use of a grounding switch 40 that only requires mechanical movement to be activated and does not necessarily sense the electrical contact. Here, the operator contacts the contact member 44A which is connected to ground, but the actual switching occurs based on mechanical movement of an element connected to the grounding switch 40, e.g., the contact member 44A.

Movement of the releasable interlock 42 from the lock position 42A to the release position 42B can be accomplished manually or automatically using an optional automatic locking device 43 driven by, for example, pneumatics, electro-mechanics, e.g., with the use of motors, or by any other form of providing a mechanical locking function automatically.

The grounding operation, wherein the operator contacts the contact member 44A which activates the grounding switch 40 the grounding device 44 can be performed in a number of ways in accordance with the present invention. For example, the grounding device 44 may include a grounded button, a grounded lever that requires, for example, lifting or sliding to activate, a grounded handle on a rotatable switch, a grounded touch sensitive point on the dispenser, or any other similar device. Additionally, as described below, the grounding device 44 can be located so that it interferes with returning the nozzle to the nozzle boot 32. The contact member 44A is electrically connected to ground (earth) and is located on the grounding device 44 such that the when the operator moves the lever, button, etc., of the grounding switch 40, the operator must make physical contact with the contact member and is thereby electrically connected to ground.

Once the grounding has been performed and the grounding switch 40 has been activated, the releasable interlock 42 causes the fuel fill nozzle 32 to be releasable from the fuel tank nozzle port 32.

Figure 3:
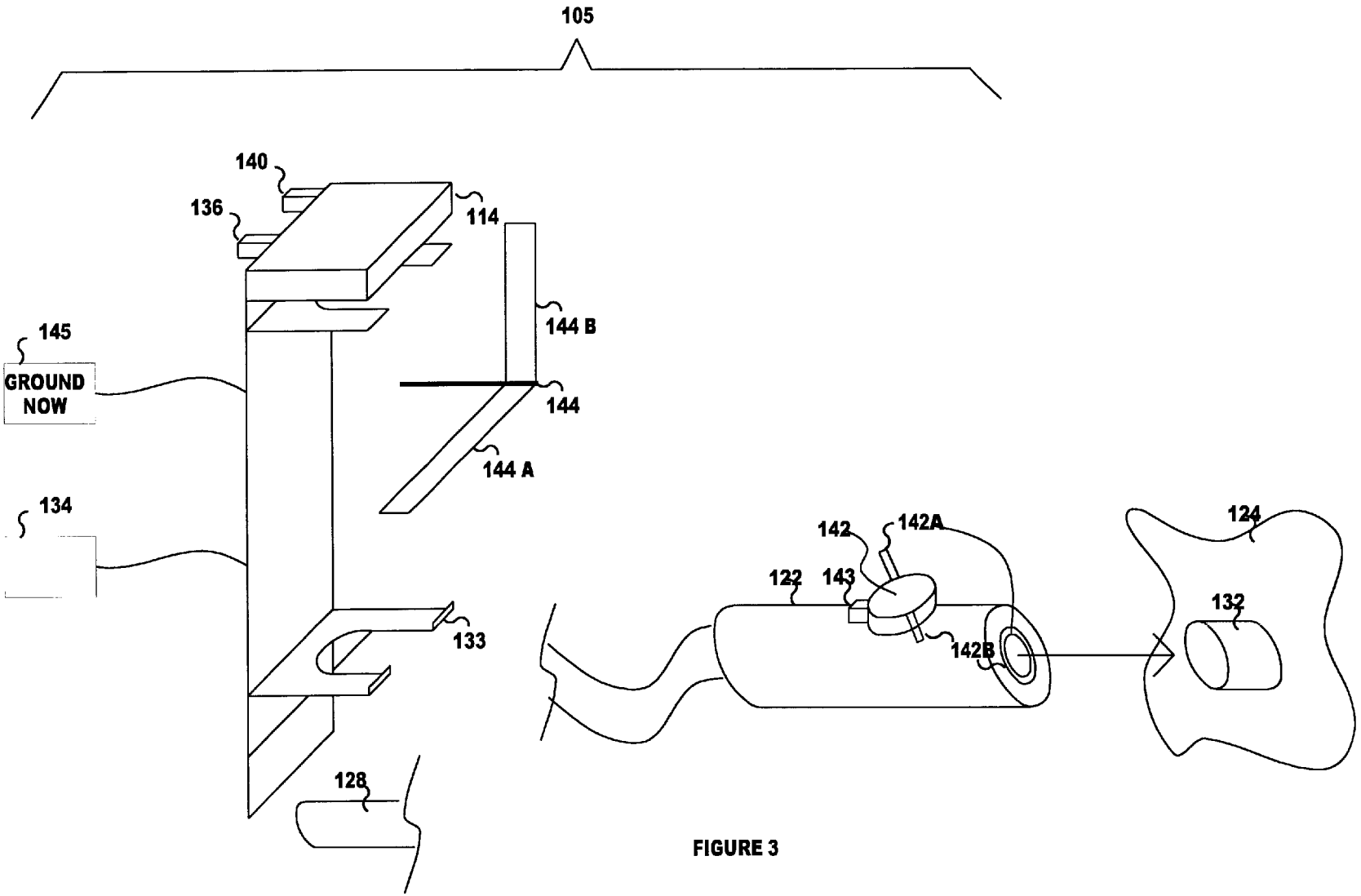
FIG. 3 is a simplified view of a nozzle and port in accordance with a second preferred embodiment of the present invention, for use in the fuel filling station of FIG. 1.

FIG. 3 depicts an alternate safety system 105 of the present invention. For the sake of simplicity, like parts with respect to the first embodiment will be designated as a one hundred series number. For example, nozzle 22 in the first embodiment will be designated nozzle 122 in this embodiment. Optionally, as can be seen in FIG. 3, the switch 140 in combination with the contact member 144 may be a lever that activates the switch 140 where the lever is located so that it must be in the release position 144B (i.e., a grounded verified position) in order to remove or replace the nozzle 122 in the nozzle boot. The contact member 144A, in this embodiment, is integral to the lever, such that when the operator contacts the lever to move the lever, the operator must contact the contact member 144A and thereby grounds himself.

With either of the safety system 5 or safety system 105, optionally, a grounding verification switch 136 may be used such that fueling may only proceed while the grounding verification switch 136 is activated (shown in FIG. 3 only). Here, the grounding verification switch 136 is connected to the fuel flow controller 18 (FIG. 1) which allows flow of fuel only when the grounding verification switch 136 is activated. The grounding verification switch 136 is connected to the contact member 144A which is electrically connected to ground. In this manner, the operator must be continuously grounded during the fueling process while fuel is flowing. A timer as described below may be incorporated.

A timer 34, 134 may be included as part of the safety system 5, 105 of the present invention. Here, the timer 34, 134 ensures that the operator does not generate enough static between grounding and touching of the fuel nozzle that may cause discharge of significant energy release to ignite the fuel air mixture. Once the operator has activated the grounding switch 40, 140 (and has therefore contacted the contact member 44A, 144A and has caused the releasable interlock 42, 142 to move to the release position 42B, 142B), the operator has a limited time (for example, about 1 to 300 seconds, and preferably about 5 seconds) to disconnect the fuel fill nozzle 22, 122 from the vehicle fuel tank port 32, 132. After that time, if the nozzle 22, 122 is not disconnected from the vehicle fuel tank port 32, 132, the nozzle 22, 122 is again locked by the releasable interlock 42, 142 from the release position 42B, 142B to the lock position 42A, 142A so that re-grounding of the operator is necessary for the operator to disconnect the nozzle 22, 122 from the vehicle port 32, 132. An indicator 45, 145 such as an indicator light, message screen, LEDs, and the like, may be used to indicate to the operator that he or she must activate the grounding device 44, 144 by contacting the contact member 44A, 144A.

Figure 4:
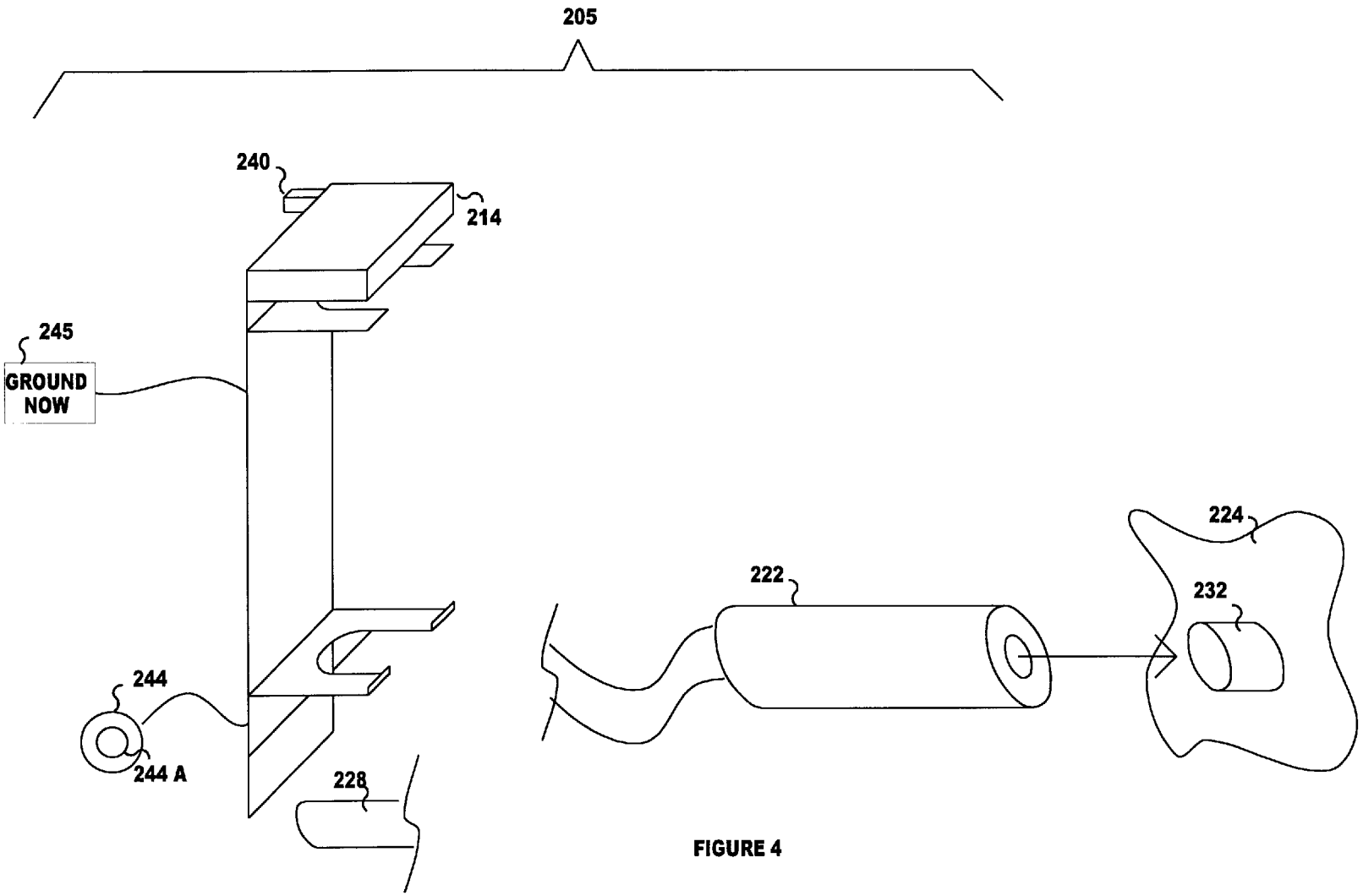
FIG. 4 is a simplified view of a nozzle and port in accordance with a third preferred embodiment of the present invention, for use in the fuel filling station of FIG. 1.

FIG. 4 depicts another alternate embodiment of the safety system 205 of the present invention. For the sake of simplicity, like parts with respect to the first embodiment will be designated with a two hundred series number. For example, nozzle 22 in the first embodiment will be designated nozzle 222 in this embodiment. The safety system 205 includes a fuel tank port 232, a fuel fill nozzle 222, and a grounding device 244 adjacent to or near the fuel tank nozzle 232. The grounding device 232 includes a grounding switch 240 and has a contact member 244A to receive physical contact by the operator such that physical contact of the contact member activates the grounding switch 240. The grounding switch 240 is in communication with the fuel controller 18 (see FIG. 1) such that fuel is supplied, as controlled by the fuel controller 18, only when the grounding switch 240 is continuously activated. The grounding device, i.e., the grounding switch and contact member is, in effect, a fuel activation handle.

Figure 5:
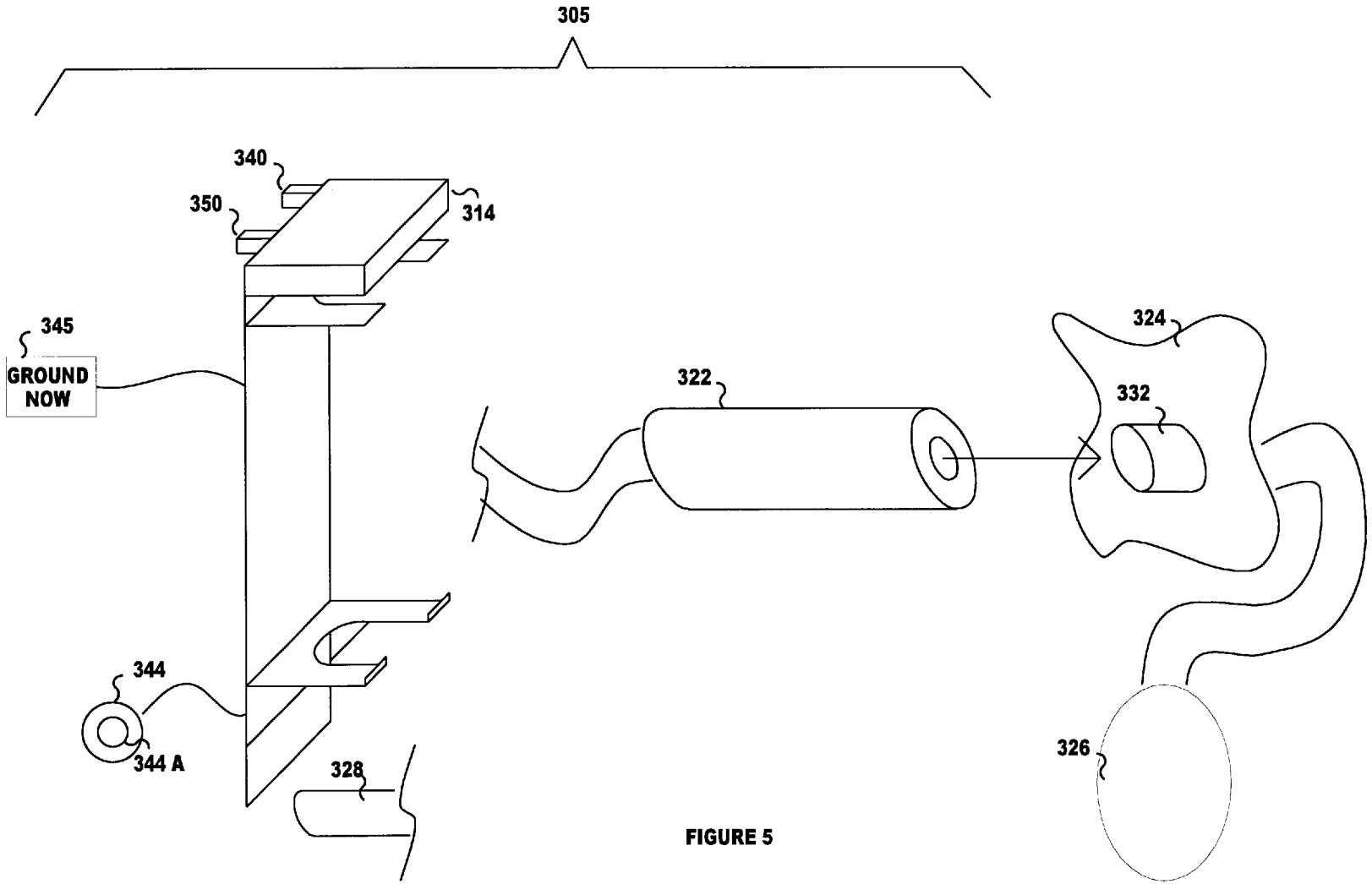
FIG. 5 is a simplified view of a nozzle and port in accordance with a fourth preferred embodiment of the present invention, for use in the fuel filling station of FIG. 1.

FIG. 5 depicts another alternate embodiment of the safety system 305 of the resent invention. For the sake of simplicity, like parts with respect to the first embodiment will be designated with a three hundred series number. For example, nozzle 22 in the first embodiment will be designated nozzle 322 in this embodiment. Here, the safety system 305 again contains no releasable interlock. Here, a fuel fill nozzle 322, a fuel tank nozzle port 332 and a grounding device 344 are included. The grounding device includes a contact member 344A that is connected to ground. The grounding device 344 also includes a grounding switch 350. The fuel controller 18 (see FIG. 1), for controlling fuel flow through the nozzle, is included wherein when the contact member 344A of the grounding device 344 is contacted, thereby activating the grounding switch 340, the fuel controller 18 provides for fuel to flow. If the contact member 344A is released or when the fuel tank 326 has reached capacity, the fuel controller 18 causes fuel to stop flowing. The fuel controller 18 then provides a signal to an indicator 345, such as a display screen or light that indicates to the operator, immediately upon receiving the signal, that grounding must take place prior to removal of the nozzle.

Figure 6:
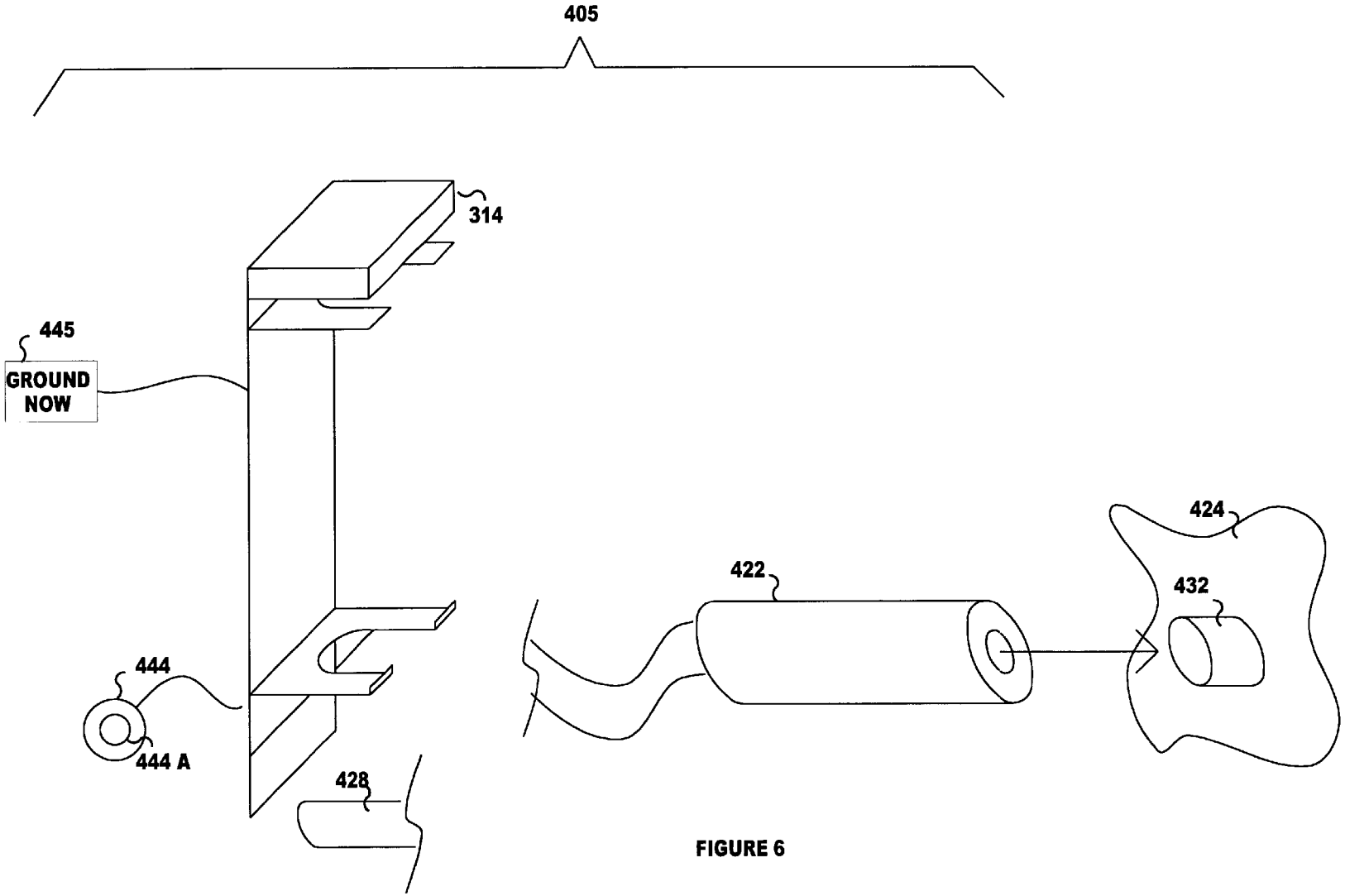
FIG. 6 is a simplified view of a nozzle and port in accordance with a fifth preferred embodiment of the present invention, for use in the fuel filling station of FIG. 1.

FIG. 6 depicts another alternate embodiment of the safety system 405 of the present invention. For the sake of simplicity, like parts with respect to the first embodiment will be designated with a four hundred series number. For example, nozzle 22 in the first embodiment will be designated nozzle 422 in this embodiment. This embodiment includes only a fuel fill nozzle 422, a fuel tank nozzle port 432, a grounding device 444, a fuel flow controller 18 (see FIG. 1), and an indicator 445. When the fuel flow controller 18 senses that fuel is no longer flowing, either due to the fuel tank being full or the operator shutting off flow of fuel, the fuel flow controller sends a signal to the indicator 445 to indicate to the operator that he or she should contact ground prior to removal of the nozzle from the port.

In use, in all of the above systems, the operator places the nozzle in the port and performs the appropriate required function based on the above systems in order to withdraw the nozzle from the port.

Although illustrated and described herein with reference to specific embodiments, the present invention nevertheless is not intended to be limited to the details shown. Rather, various modifications may be made in the details within the scope and range of equivalents of the claims without departing from the spirit of the invention.

We claim:

1. A safety system for grounding an operator at a fueling station prior to removing a fuel fill nozzle from a fuel tank upon completion of a fuel filling operation, said fuel fill nozzle connected to a fuel source by a fuel conduit, said safety system comprising:

a) a fuel tank port in communication with said fuel tank for receiving and retaining said fuel fill nozzle during the fuel filling operation;

b) a grounding device adjacent said fuel tank port, said grounding device including a grounding switch having a contact member adapted to receive physical contact by the operator, wherein physical contact of said contact member activates said grounding switch; and c) a releasable interlock providing a lock position wherein said nozzle is locked into said port upon insertion of said nozzle into said port and a release position wherein said nozzle is releasable from said fuel tank port upon completion of the fuel filling operation and after physical contact of said contact member is accomplished;

whereby accidental ignition of fuel due to static discharge is prevented.

2. The safety system of claim 1, wherein said grounding device is located at least 2 centimeters from said nozzle.

3. The safety system of claim 1, wherein the fuel source contains a compressed fuel.

4. The safety system of claim 1, wherein said fuel tank is a fuel cell fuel tank.

5. The safety system of claim 1, wherein said releasable interlock is a manually activated nozzle lever, wherein movement of said nozzle lever in a first direction locks said nozzle to said fuel tank port and wherein movement of said nozzle lever in a second direction unlocks said nozzle from said fuel tank port only upon activation of said rounding switch.

6. The safety system of claim 1, including a timer connected to said releasable interlock, said timer providing for said releasable interlock to remain in said release position for a limited time period subsequent to activation of said grounding switch, said timer providing for said releasable interlock to remain in said locked position at all other times when said nozzle is received in said port.

7. The safety system of claim 6, wherein said limited time period is about one to three hundred seconds and preferably about five seconds.

8. The safety system of claim 6, including an indicator to provide indication that said nozzle may safely be removed from said receptacle, said indicator providing indication during said limited time period.

9. The safety system of claim 1, wherein the grounding switch is integral to the releasable interlock.

10. The safety system of claim 9, wherein said releasable interlock is a lever adapted to move from said lock position to said release position, whereby said lever blocks said nozzle from removal from said fuel tank port until moved from said lock position to said release position.

11. The safety system of claim 1, including a grounding verification switch adjacent to said nozzle and a timer connected to said releasable interlock, said grounding verification switch connected to a fuel controller, said fuel controller enabling flow of said fuel from said nozzle only during activation of said grounding verification switch, said timer providing for said releasable interlock to remain in said release position for a limited time period subsequent to release of said grounding verification switch.

12. The safety system of claim 11, wherein said grounding verification switch includes an activation handle on said nozzle that additionally controls flow of fuel.

13. The safety system of claim 1, including a grounding verification switch and a timer, said grounding verification switch connected to a fuel controller, said fuel controller enabling flow of said fuel from said nozzle only during activation of said grounding verification switch, said timer connected to said fuel controller and providing for flow of fuel to resume once halted by release of said grounding verification switch for a limited time period subsequent to release of said grounding verification switch, and wherein said fuel controller provides for no fuel to flow after said limited time period has been reached until said grounding switch is re-activated.

14. A safety system for grounding an operator at a fueling station during a fuel filling operation, comprising:

a) a fuel tank port in communication with a fuel tank for receiving a fuel fill nozzle;

b) a grounding device adjacent said fuel tank port, said grounding device including a grounding switch having a contact member adapted to receive physical contact by the operator; wherein physical contact of said contact member activates said grounding switch; and c) a fuel controller for providing fuel flow through said nozzle only when said grounding switch is continuously activated;

whereby accidental ignition of fuel due to static discharge is prevented.

15. A safety system for grounding an operator at a fueling station during a fuel filling operation, comprising:

a) a fuel tank port in communication with a fuel tank for receiving a fuel fill nozzle;

b) a grounding device adjacent said fuel tank port, said grounding device including a contact member connected to ground adapted to receive physical contact by the operator;

c) a fuel controller for controlling fuel flow through said nozzle, said fuel controller providing for a flow of fuel and providing a signal when said controller provides fuel to stop flowing; and d) an indicator that indicates to the operator, immediately upon receiving said signal, that grounding must take place prior to removal of said nozzle;

whereby accidental ignition of fuel due to static discharge is prevented.

16. A method for grounding an operator at a fueling station comprising the steps of:

a) providing a fuel tank port in communication with a fuel tank for receiving and retaining a fuel fill nozzle during a fuel filling operation;

b) providing a grounding device adjacent to the fuel tank port, the grounding device including a grounding switch having a contact member to receive physical contact by the operator, wherein physical contact of the contact member activates the grounding switch;

c) providing a releasable interlock having a lock position wherein the nozzle is locked into the port upon insertion of the nozzle into the port and a release position wherein the nozzle is releasable from the fuel tank port upon completion of the fuel filling operation and after physical contact of the contact member is accomplished;

d) withdrawing the fuel fill nozzle from a fuel source boot;

e) inserting the fuel fill nozzle into the fuel tank port wherein the nozzle is locked into the fuel tank port;

f) filling the fuel tank with fuel from a fuel source;

g) contacting the contact member to activate the grounding switch of the grounding member to release the releasable interlock; and h) withdrawing the nozzle from the port;

whereby accidental ignition of fuel due to static discharge is prevented.

17. The method of claim 16, wherein the step of providing the releasable interlock includes providing a manually activated nozzle lever, wherein movement of the nozzle lever in a first direction locks the nozzle to the fuel tank port to allow flow of fuel and wherein movement of the nozzle lever in a second direction unlocks the nozzle from the fuel tank port and is enabled only upon activation of the grounding switch, and wherein the step of contacting the contact member enables movement of the nozzle lever in the second direction.

18. The method of claim 16, including a step of providing a timer connected to the releasable interlock, the timer providing for the releasable interlock to remain in the release position for a limited time period subsequent to activation of the grounding switch, the timer providing for the releasable interlock to remain in the locked position at all other times when the nozzle is received in the port.

19. The method of claim 16, including steps of providing a fuel controller, providing a grounding verification switch and connected to the fuel controller, and providing a timer connected to the releasable interlock, the fuel controller enabling flow of the fuel from the nozzle only during activation of the grounding verification switch, the timer providing for the releasable interlock to remain in the release position for a limited time period subsequent to release of the grounding verification switch, wherein the step of contacting the contact member enables movement of the nozzle lever in the second direction for the limited time period.

20. The method of claim 16, including steps of providing a fuel controller, providing a grounding verification switch and connected to the fuel controller, and providing a timer, the fuel controller enabling flow of the fuel from the nozzle only during activation of the grounding verification switch, the timer connected to the fuel controller and providing for flow of fuel to resume once halted by release of the grounding verification switch for a limited time period subsequent to release of the grounding verification switch, and wherein the fuel controller provides for no fuel to flow after the limited time period has been reached until the grounding switch is re-activated , wherein the step of filling the fuel tank includes releasing the grounding verification switch during fueling thereby stopping flow of fuel and contacting the contact member to reactivate the grounding switch to restart the flow of fuel.

21. A method for grounding an operator at a fueling station during a fuel filling operation, comprising:

a) providing a fuel tank port in communication with a fuel tank for receiving a fuel fill nozzle during the fuel filling operation;

b) providing a grounding device adjacent to the fuel tank port, the grounding device including a grounding switch having a contact member to receive physical contact by the operator, wherein physical contact of the contact member activates the grounding switch;

c) providing a fuel controller that is activatable by the grounding switch to provide fuel flow through the nozzle only when the grounding switch is continuously activated; and d) physically contacting the contact member to activate the grounding switch to activate the fuel controller to provide fuel flow;

whereby accidental ignition of fuel due to static discharge is prevented.

22. A safety system for grounding an operator at a fueling station during a fuel filling operation, comprising:

a) providing a fuel fill nozzle connected to a fuel source;

b) providing a fuel tank port in communication with a fuel tank for receiving the fuel fill nozzle;

c) providing a grounding device adjacent to the fuel tank port, the grounding device including a contact member connected to ground adapted to receive physical contact by the operator;

d) providing a fuel controller for controlling fuel flow through the nozzle, the fuel controller providing a signal when the controller provides fuel to stop flowing;

e) providing an indicator that indicates to the operator, immediately upon receiving the signal, that grounding must take place prior to removal of the nozzle;

f) inserting the nozzle into the fuel tank port;

g) inputting a desired quantity of fuel into the fuel tank via the fuel controller until the desired quantity of fuel has been transferred into the fuel tank or the fuel tank has reached capacity;

h) providing the signal from the controller to the indicator to indicate to the operator that the operator must contact the contact member;

i) contacting the contact member; and j) removing the nozzle from the fuel tank port;

whereby accidental ignition of fuel due to static discharge is prevented.

* * * * *